United States Patent [19]

Pollock

[11] 4,088,172

[45] May 9, 1978

[54] DUAL PURPOSE SECURITY SHUTTER AND AWNING ASSEMBLY

[76] Inventor: Alexander Pollock, 16179 Bentler, Detroit, Mich. 48219

[21] Appl. No.: 746,716

[22] Filed: Dec. 2, 1976

[51] Int. Cl.[2] ..... E05D 15/26

[52] U.S. Cl. ..... 160/193; 160/207

[58] Field of Search ..... 160/189, 193, 207, 133

[56] References Cited

U.S. PATENT DOCUMENTS

| | | | |
|---|---|---|---|
| 1,619,816 | 3/1927 | Gervais | 160/189 |
| 2,327,316 | 8/1943 | Michelman | 160/207 |
| 2,898,988 | 8/1959 | Zoll | 160/133 |
| 2,990,012 | 5/1961 | Riebling | 160/193 |
| 3,155,147 | 11/1964 | Smith | 160/207 |

*Primary Examiner*—Peter M. Caun

*Attorney, Agent, or Firm*—Cullen, Settle, Sloman & Cantor

[57] ABSTRACT

A combination security shutter and awning assembly adapted to be secured to a wall of a building such as a store front or the like having one or more wall openings therein such as doors, display windows, and the like. The assembly includes upper and lower sash portions which are positionable to an opened awning position wherein the sash portions are disposed above the wall openings and function as an awning which is pleasing to the eye and which provides an unobstructed passage or view of the various wall openings. The sash portions of the assembly are also selectively positionable to a closed security shutter position whereby access to the wall openings is prevented by relatively burglar-resistant panels. The assembly includes a frame rigidly secured to the wall about the wall openings and is adapted to carry the upper and lower sash portions each of which mounts at least one protective panel. The upper sash portion is hingeably connected to the lower sash portions and the sides of the lower sash portion are provided with rollers adapted to operatively engage tracks at the sides of the frame. A selectively operable winch is provided including at least one cable having one end wrapped about the winch drum and the opposite end coupled to the lower sash portions such that the selective operation of the winch will cause the cable to be wound and unwound from the drum to selectively raise and lower the rollers within the tracks thereby selectively positioning the sash apparatus between the raised awning position and the closed shutter position. The protective panel may be provided with decorative designs or patterns, if desired, and locking apparatus may be provided for securing the assembly in the closed security shutter position during non-business hours and the like.

14 Claims, 15 Drawing Figures

DUAL PURPOSE SECURITY SHUTTER AND AWNING ASSEMBLY

BACKGROUND OF THE INVENTION

1. Field of the Invention

This invention relates generally to a combination awning and shutter and more particularly to a combination security shutter and awning assembly which may serve both decorative and functional purposes when in the awning position and which may be readily positionable and locked in the closed security shutter position to protectably seal off the wall openings to prevent access to the building during non-business hours and the like without obstructing sidewalk traffic or presenting an unsightly appearance.

The present invention employs protective panels comprising a relatively burglar-resistant material which may itself be decorative or include designs or decorative patterns thereon. When in the opened awning position, the assembly is positioned overhead so that as not to interfere with traffic passing on the sidewalk in front of the building and so as to allow a free and open physical access to the door and visual access to the display windows and the like. The assembly in the awning position will be pleasing to the eye and serve to protect pedestrians from rain and snow in inclement weather and to shade pedestrians and to shield the merchandise in the windows from harmful rays from the sun on hot sunny days.

In the closed security shutter position, the assembly lies nearly flush with the building wall so as not to obstruct or interfere with pedestrian traffic passing in front of the building. The protective panels present a pleasing appearance rather than the dreary and foreboding appearance offered by iron bars or metal grating of the prior art, yet still provide a large measure of protection from burglars, vandals and the like.

2. Description of the Prior Art

The prior art teaches many types of security devices for protecting wall openings such as doors, display windows and the like. Most of these security devices are extremely unsightly, and many do not completely protect the windows from vandalism since objects thrown by vandals often pass between the bars or metal grating and cause damage to the windows and the like. Furthermore, when a large number of stores and other business facilities in an area are protected by the prior art security devices, potential customers and shoppers seeing the security devices during non-business hours, are often frightened or receive a bad impression of the area and tend to do their shopping elsewhere. The effect of a large number of businesses using the forebodying prior art devices is to create an aura of apprehensiveness about the neighborhood which tends to discourage rather than encourage future growth and development of the area.

The prior art also teaches many types of awning assemblies although most are single purpose awnings which serve to protect pedestians from sun and rain during the summer months but which are removed and stored during the winter months because they have low snow load and/or wind load capacities and would collapse under the weight of snow experienced in most northern cities during the winter months.

Further, the prior art includes several types of combination shutter and awning devices but most of these are adapted for covering a single window of a domestic dwelling. Others are awkward and cumbersome and tend to obstruct pedestrian traffic when in a closed position. Most are relatively unsightly at least in the shutter position and all of the larger types capable of covering a display window or the like appear to involve relatively complex mechanical mechanisms for constructing and for raising and lowering the apparatus between the shutter and awning positions.

The present invention avoids most of the problems and disadvantages of the prior art by providing a dual purpose security shutter and awning assembly which is both decorative and functional when in either the awning or the shutter postion. The assembly of the present invention is relatively simple to install, easy to maintain, and easy to operate. The assembly of the present invention does not obstruct pedestrian traffic in either the opened or closed positions and tends to produce a pleasant and cheerful aura in the business district even during non-business hours which is conducive to the economic growth of business in the area since potential shoppers and customers will be attracted to rather than repelled from business districts employing the assembly of the present invention. At the same time, the assembly provides a high degree of protection during non-business hours from burglars, vandals and the like.

The present invention teaches a single relatively simple mechanical assembly which provides adequate protection while simultaneously promoting the business growth and customer appeal which was heretofore unachievable by any of the security shutters of the prior art.

BRIEF SUMMARY OF THE INVENTION

This invention provides a combination security shutter and awning assembly comprising a frame adapted to be secured to the wall of a building or the like. The frame has a top portion and opposite side portions and is rigidly secured to the wall of the building so as to be disposed about at least one wall opening, such as a door, a display window, or the like therein. The assembly is provided with first and second sash means each of which is adapted to mount at least one protective panel therein. The sash means are positionable to a closed shutter position wherein the plane of the first sash means is substantially parallel to the plane of the second sash means and generally coplanar therewith for protectively sealing off the wall opening. The sash means are also positionable to an opened awning position wherein the plane of the first sash means facing the wall forms an acute angle with the plane of the second sash means facing the wall for permitting an unobstructed access to the wall openings. Means are provided for selectively raising and lowering the sash means between the closed shutter position and the opened awning position and means may be provided for locking the sash means in the closed shutter position for security purposes.

The present invention provides a winch secured to the frame for raising and lowering the sash means. The sides of the frame are provided with tracks and roller bearing means are provided on opposite sides of the second or lower sash means to operatively engage corresponding tracks so as to ride up and down said tracks as the sash means move between the opened and closed positions. One or more cables are provided having one end portion wrapped about the winch drum, an intermediate portion passing over one or more pulleys suspendedly carried by the top of the frame, and the opposite end secured to the lower sash means so that as the winch drum is rotated to wind and unwind the cables thereon, the roller bearing means is caused to ride up and down in the track so as to moveably position the sash means between the opened awning position and the closed shutter position.

Various locking means may be provided to selectively secure or retain the assembly in the closed shutter protection position during non-business hours for security purposes. The protective panels mounted in the sash means may include transparent, translucent or opaque plastic, fiberglass or metallic material which is relatively burglar-resistant and the panels may be provided with decorative patterns or designs thereon for aesthetic purposes.

The combination security shutter and awning assembly of the present invention is basically modular in design and the number of protective panels carried by the first and second sash means may be varied depending upon the size of the wall opening or the area of the wall of a building having a plurality of openings to be protectively covered. The plurality of individual sashes making up either the first or the second sash means are secured along adjacent edges so that the first sash means and the second sash means each operate independently as an integral unit. The first and second sash means are hingeably secured to one another to open and shut in a flap-like manner as the roller bearing means slides up and down the track means during positioning of the assembly.

Various means may be provided for locking the sash means in the closed shutter position for security purposes and means may be provided for shielding the hinges to prevent the assembly from attaining an over-the-center position from which it is difficult to recover and to prevent tampering with the hinge mechanism by potential burglars or vandals.

The present invention is relatively simple to construct and install. It is mechanically simple, easy to maintain and simple to operate. The present invention is both functional and decorative in both the awning position and in the closed security shutter position.

Even when the assembly of the present invention is in the closed security position, it does not protrude outwardly from the buidling so as to obstruct pedestrian traffic but lies parallel to and nearly flush against but spaced slightly from the wall of the building. Furthermore, the nature of the material used in the protective panels and/or the decorative designs or patterns thereon do not produce a dreary and dismal atmosphere and a sense of foreboding and apprehensiveness on the part of the potential customers but rather emote an aura of cheer and goodwill thus promoting the growth of business districts employing such devices and encouraging customers and shoppers to frequent such neighborhood establishments.

Other advantages and meritorious features of the present invention will be more fully undertood from the following detailed description of the drawings and the preferred embodiment, the appended claims and the drawings which are briefly described hereinbelow.

BRIEF DESCRIPTION OF THE DRAWINGS

FIG. 1 is a front view of a portion of the wall of a building having wall openings therein protected by the dual purpose security shutter and awning assembly of the present invention;

DETAILED DESCRIPTION OF THE INVENTION

Figure 2:
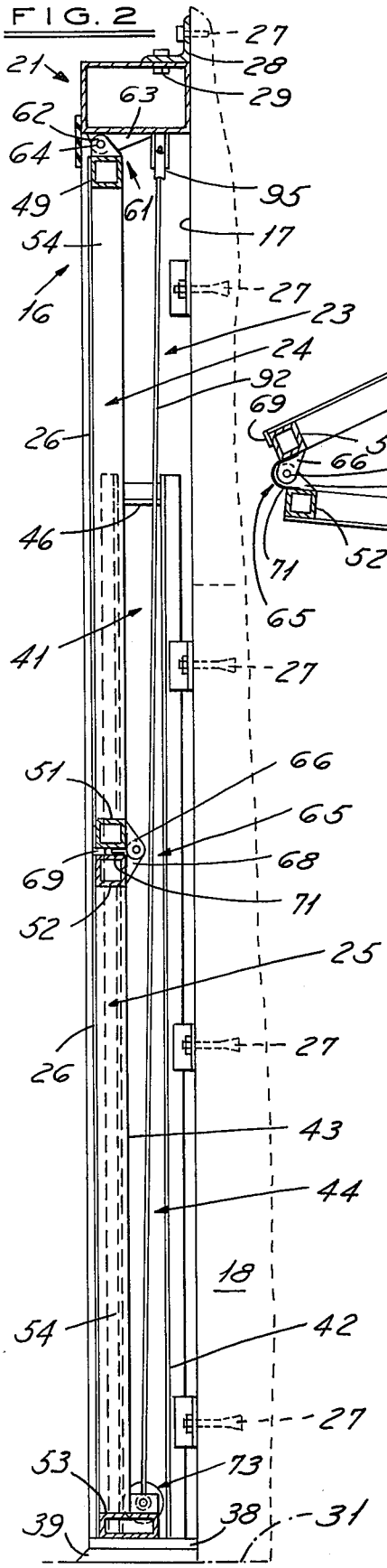
FIG. 2 is a sectional side view taken along view lines 2—2 of FIG. 1 showing the dual purpose security shutter and awning assembly of the present invention in the closed security shutter position.
Figure 3:
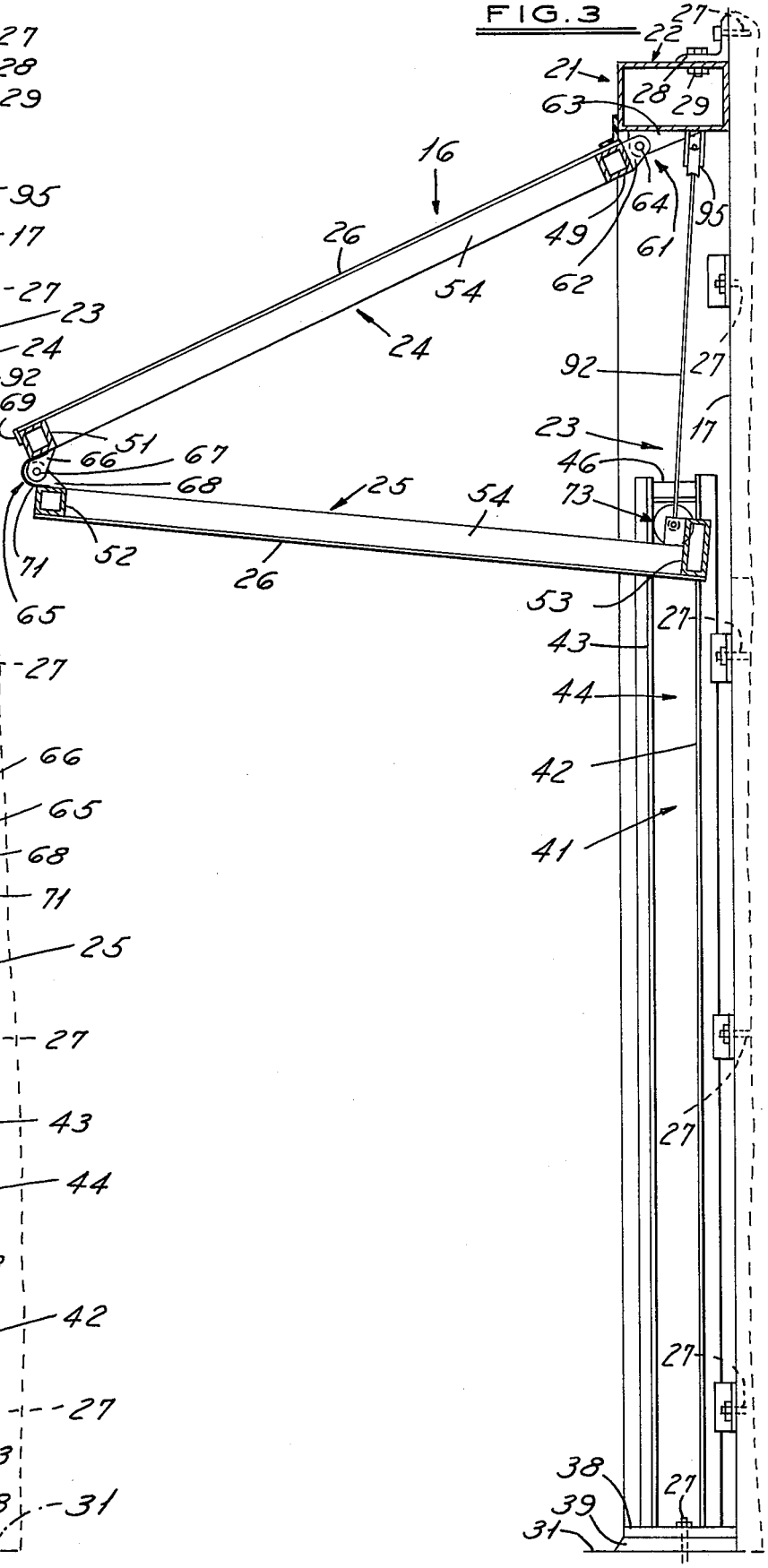
FIG. 3 is a sectional side view taken along view lines 3—3 of FIG. 1 showing the dual purpose security shutter and awning assembly of the present invention in the opened awning position.
Figure 5:
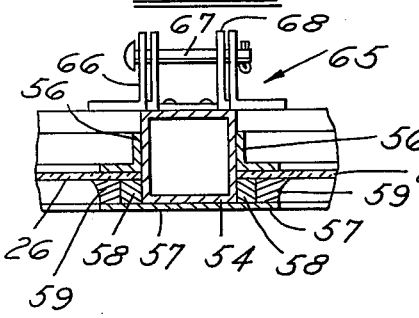
FIG. 5 is a top sectional view taken along view lines 5—5 of FIG. 1 illustrating the means for connecting adjacent individual sashes and protective panels.

FIGS. 1, 2 and 3 show the dual purpose or combination security shutter and awning assembly 16 of the present invention adapted to be secured to a wall 17 of a building 18 such as a store front or the like having one or more wall openings therein such as a door 19, display windows 20, and the like. The assembly 16 includes a frame 21 having a substantially horizontal top portion or member 22 and a pair of substantially vertical side portions or members 23 disposed about the wall openings 19, 20. The frame carries a first upper sash assembly or portion 24 and a second lower sash assembly or portion 25 each of which is adapted to mount at least one relatively burglar-resistant or protective panel 26 therein.

The sash portions 24, 25 are selectively positionable to an opened awning position, as shown in FIG. 3, wherein the sash portions 24, 25 are disposed above the wall openings 19, 20 such that the protective panels 26 mounted within the sash portions 24, 25 serve as an awning which is pleasing to the eye and which provides an unobstructive passage or view of the various wall openings 19, 20. The sash portions 24, 25 of the assembly 16 are also selectively positionable to a closed security shutter position, as illustrated in FIG. 2, whereby access to the wall openings 19, 20 is prevented by the protective panels 26. The protective panels 26 are preferably ornamental as well as functional and may be aesthetically pleasing in and of themselves or may include decorative designs or patterns thereon so as to present a pleasing appearance even when the assembly 16 is in the closed security shutter position of FIG. 2.

The frame 21 is anchored or secured to the wall 17 of the building 18 by means of a plurality of anchor bolt assemblies 27 although any type of similarly conventional fastening means may be used. The generally horizontal top portion 22 of the frame 21 may include a hollow steel suspension beam or the like which is secured to the wall 17 by L-shaped bracket assemblies 28 having one leg anchored to the wall 17 by an anchor bolt assembly 27 and the other leg secured to the top member of the member 22 by a conventional nut and bolt combination 29 or any other suitable conventional fastening means. The top member 22 is generally horizontal, is disposed a sufficient distance above the openings 19, 20 so as to insure adequate clearance when the sashes 24, 25 are in the opened awning position of FIG. 3, and extends laterally along the wall 17 a distance sufficient to insure that all of the openings 19, 20 to be protected by the assembly 16 can be enclosed thereunder. The top portion 22 may be a hollow steel beam but it must be sufficiently strong to bear substantially all of the weight of the assembly 16 even under maximum snow load conditions. Additionally, the member 22 must be sufficiently wide, as measured perpendicular to the wall 17, to insure proper spacing of the assembly 16 from the wall 17 so as to provide adequate protection while insuring that the assembly 16 does not interfere with pedestrian traffic passing in front of the building 18.

The side portions 23 are parallel with one another and are substantially vertically disposed between the end portions of the top portion 22 and the ground plane 31. In the preferred embodiment, the side portions 23 may be anchored to the ground plane 31 by means of anchor bolt assemblies 27 or the like, if desired. Along with the anchor bolt assemblies 27, or in lieu thereof, the side portions 23 may rest upon concrete footings 32 or the like, if desired. The length of the side portion 23 is sufficient to reach from the top portion 22 to the ground plane 31 and its width is sufficient to properly position the assembly 16 with respect to the wall 17 as previously described.

Figure 8:
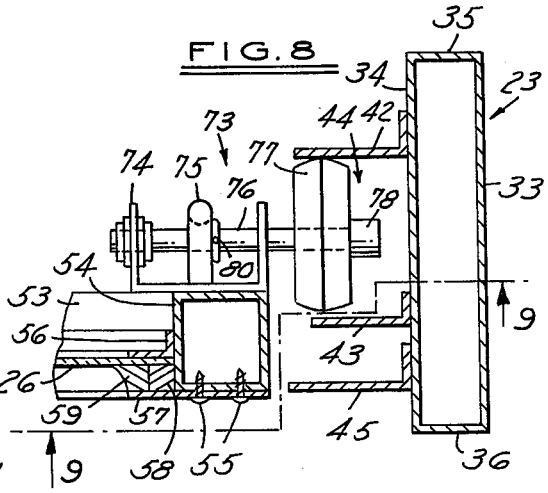
FIG. 8 is a sectional top view taken along view lines 8—8 of FIG. 1 showing the roller bearing means, the track means, and the edge portion of the lower sash means of the shutter and awning combination of the present invention.
Figure 9:
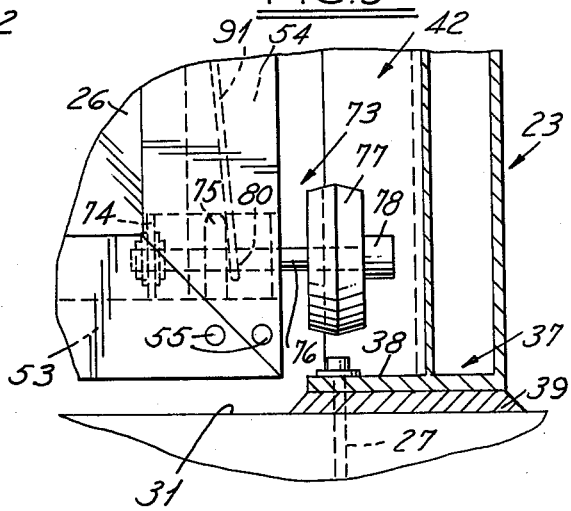
FIG. 9 is a sectional front view taken along view lines 9—9 of FIG. 8 and illustrating the front edge portion of the lower sash means, the roller bearing means, and the side portion of the frame near the base thereof of the shutter and awning assembly of the present invention.

FIG. 8 shows a sectional top view of the side portion 23 of the present invention and shows that each of the generally rectangular steel side portions 23 has an outside surface 33, an inside surface 34 disposed opposite from and opposing a corresponding inner surface 34 on the side portion 23 on the opposite side of the frame 21. Additionally, the side portions 23 have an inner edge 35 which is adapted to be disposed flush against the wall 17 of the building 18 and secured thereto by anchor bolt assemblies 27 and at an outer edge 36. The inside and outside surfaces 33, 34 are parallel to one another and their length, which is the distance between the parallel inner and outer edges 35, 36 determines the spacing of the assembly 16 from the wall 17. As shown in FIG. 9, the lower end portion 37 of the side portions 23 terminates in an inwardly facing flanged extension 38 which may be securely anchored to the ground plane 31 by means of an anchor bolt assembly 27. Additionally, the space between the bottom of the flanged extension 38 and the ground plane 31 may be packed with conventional premolded joint filler 39 if desired.

A track assembly 41 is provided along the side portions 23, as illustrated in FIGS. 2, 3, 8 and 9. The track assembly 41 may include a first generally L-shaped inside track member 42 having the bottom surface of one of the arms of the L-shaped track 42 rigidly secured to the inside surface 34 of the side portion 23, as by welding or any similarly suitable conventional fastening means. A second generally L-shaped track member 43 is parallel to and spaced apart from the track member 42 and similarly has bottom surface of one arm thereof rigidly secured to the inside surface 34 of the side portion 23 as by welding or the like so as to provide a track passage 44 between the opposing surfaces of the track elements 42, 43 which is substantially vertical and extends from adjacent to the ground plane 31 toward the top portion 22 at least a distance sufficient to allow the sash portions 24, 25 to be sufficiently overhead to allow free physical and visual passage therebeneath when the assembly 16 is in the opened awning position as shown in FIG. 3.

Additionally, a third generally L-shaped shielding 45 element may be disposed outside of the track element 43 and further away from the wall 17 so as to protect the track assembly 41 and prevent tampering and the like. The lower surface of one of the arm portions of the element 45 is rigidly secured to the inside surface 34 of side portion 23 as by welding or the like. Lastly, the track assembly 41 may be provided with a stop element 46 secured between the track element 42 and 43 across the track space 44 to terminate the track assembly 41 adjacent to the upper end 47 thereof.

Figures 4, 7:
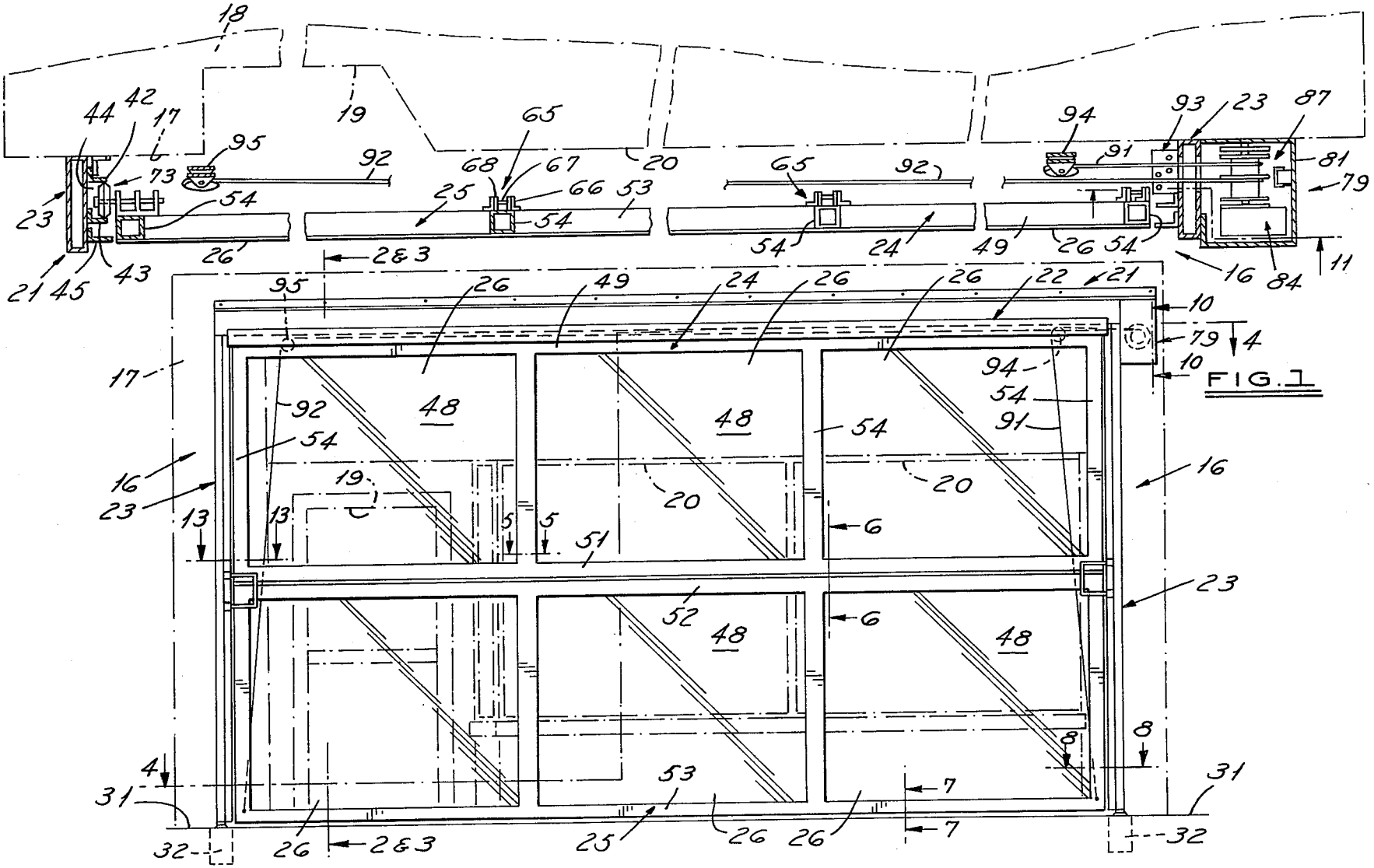
FIG. 4 is a top sectional view taken along view lines 4—4 of FIG. 1, and partially broken away.
FIG. 7 is a sectional side view taken along view lines 7—7 of FIG. 1 of the construction and illustrating the bottom edge of the lower sash means of the assembly of the present invention.
Figure 6:
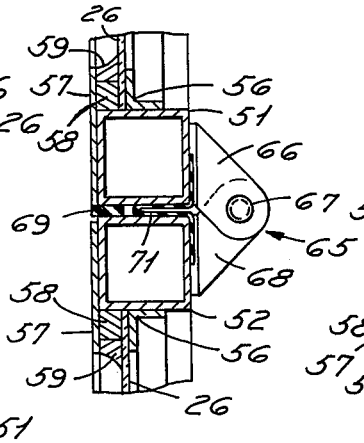
FIG. 6 is a sectional side view taken along view lines 6—6 of FIG. 1 showing the hinge assembly used to coupled the upper and lower sash means of the combination security shutter and awning assembly of the present invention when the assembly is in the fully closed security shutter position.
Figure 7:
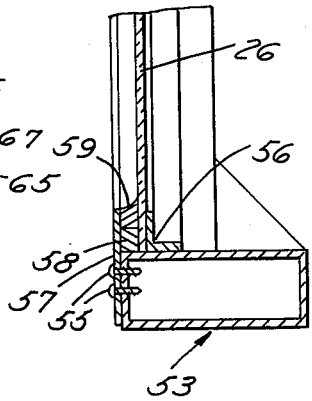

The upper and lower sash portions 24, 25 are modular in nature and may be increased or decreased as to size depending upon the area of the wall 17 and the number of openings 19, 20 to be protected by the assembly 16. Each of the sash portions 24, 25 includes one or more individual sashes 48. The individual sashes 48 are formed as described hereinbelow. The upper sash portion 24 includes generally horizontal upper and lower sash frame posts 49, 51 extending substantially along the length of the top portion 22 of the frame 21. Each of the generally horizontal frame posts 49, 51 is a hollow steel element having a substantially square cross section as illustrated in FIGS. 2, 3, and 6. Similarly, the lower sash portion 25 includes generally horizontal upper and lower sash posts 52, 53. In the preferred embodiment, the upper sash post 52 has a substantially square cross section as illustrated in FIGS. 2, 3 and 6 while the lower sash post 53 has a generally rectangular cross section as illustrated in FIGS. 2, 3 and 7.

Similarly, the upper and lower sash portions 24, 25 include a plurality of generally vertical sash posts 54. In the preferred embodiment of the present invention, the vertical sash posts 54 are hollow steel elements having a generally square cross section. The vertical sash posts 54 of the upper sash portion 24 have their upper ends weldably secured to the upper sash post 49 and their lower ends weldably secured to the lower sash post 51 while the vertical sash posts 54 of the lower sash portion 25 have their upper ends weldably secured to the upper sash post 52 and their lower ends weldably secured to the generally rectangular lower sash post 53.

The upper and lower sash portions 24, 25 are modular in that the number of individual sashes 48 defined by the area between vertically adjacent upper and lower sash posts 49, 51 or 52, 53 and laterally adjacent vertical sash posts 54 may be increased or decreased depending upon the area of the wall 17 to be protected by the assembly 16 merely by increasing the length of the horizontal sash posts 49, 51, 52, 53 either by using longer posts or by weldably attaching horizontal extensions thereto and then weldably inserting the required number of vertical sash posts 54, as required for the area desired to be covered.

Each of the individual sashes 48 mountably carries its own protective panel 26 as best illustrated with reference to FIGS. 5, 6, 7 and 15. Each of the sash posts 49–54 may have weldably secured thereto an inner, generally L-shaped panel-retaining element 56 having one arm weldably secured to a side of the post 49–54 and its opposite arm extending perpendicularly away therefrom. The protective panel 26 is disposed against the surface of the extending arm of the L-shaped retainer 56 perpendicularly away from the surface of the post. An outer retainer element 57 may be secured to an adjacent side of the post as by substitute means 55 so as to be parallel to the panel 26 and extending arm of the L-shaped retainer 56. The panel 26 is disposed between the retainer elements 56 and 57, and in the preferred embodiment, conventional filler tape 58 and/or a silicone polysulfide caulking 59 may be disposed between the outer surface of the panel 26 and the retaining element 57 for sealing purposes.

The protective panels 26 are substantially burglarproof and generally resistant to vandalism and accidental breakage. In the preferred embodiment, the panels 26 may be made from any type of suitable plastic material, for example, a polycarbonate such as lexan or the like. Additionally, plexiglass, strong fiberglass, and various types of metallic mesh could be used. In the preferred embodiment, the panels would be pleasing to the eye and they could be transparent, translucent or opaque. Similarly, various colors or color combinations could be used and the panels 26 could include thereon decorative patterns or designs, if desired.

Since the sides of the individual sashes 48 of both the upper sash portion 24 and the lower sash portion 25 are secured to one another, both the upper sash portion 24 and the lower sash portion 25 comprise generally laterally rigid structures such that each of the sash portions 24, 25 function and move as a separate integral unit.

As illustrated in FIGS. 2 and 3, the upper sash post 49 of the upper sash portion 24 is pivotally connected to the lower surface of the top portion 22 by a plurality of hinge assemblies 61. Each of the hinge assemblies 61 includes a pair of generally parallel ear members 62 which extend from the upper ends of the vertical sash posts 54 and are generally parallel to the axes thereof. Corresponding pairs of ear members 63 are weldably secured to the bottom of the top beam member 22 and are parallel to one another and are adapted to be received between the pair of ear members 62. Apertures are provided in the ear members 62 and 63 and a hinge pin 64 is mounted therein so that the upper sash portion 24 is hingeably connected to the top portion 22 of the frame 21 for flap-like movement toward and away from the wall 17.

Similarly, as illustrated in FIGS. 2, 3, 5, 6, and 15, the upper sash portion 24 is hingeably connected to the lower sash portion 25 by a plurality of hinge assemblies 65 mounted adjacent to the intersections of the vertical post 54 with the lower sash post 51 of the upper sash portion 24 and the upper sash post 52 of the lower sash portion 25. Each of the hinge assemblies 65 includes a first pair of ear-like hinge elements 66 which have one end portion secured to either the vertical posts 54 or the lower horizontal sash post 51 by welding, metal screws, or any suitable conventional fastening means. The other end portion of the first pair of hinge elements 66 are substantially parallel to and spaced apart from one another and extend generally perpendicular to the plane of the panels 26 toward the front of the wall 17. The end portions of the first pair of hinge elements 66 facing the wall 17 have an aperture therein for receiving a hinge pin or pintle 67.

A second pair of ear-like hinge elements 6 has one end portion secured to either the vertical posts 54 or the generally horizontal upper sash posts 52 of the lower sash portion 25 by welding, screw fasteners or the like. The opposite end portions of the second pair of the hinge elements 68 are generally parallel to and spaced apart from one another and disposed generally perpendicular to the plane of the panel 26 and toward the wall 17 of the building 18 generally parallel to the corresponding end portions of the first pair of hinge elements 66. The end portions of the second pair of hinge elements 68 disposed toward the face of the wall 17 are also provided with an aperture and are adapted to be received between the first pair of hinge elements 66 so that the apertures are aligned to receive the hinge pin 67 such that the second lower sash portion 25 is hingeably secured to the first upper sash portion 24 for general flap-like like movement therebetween.

Associated with each of the hinge assemblies 65, may be a spacer or shielding element 69 which serves to prevent the upper and lower sash portions 24, 25 from attaining an over-the-center position when in the fully closed security shutter position, and which would render it difficult to open the assembly 16, while simultaneously serving to shield the hinge assembly 65 from tampering for security purposes. If desired, the spacing elements 69 may extend the full length of the horizontal supports 51, 52. Furthermore, a protective cloth or rubber seal 71 may be secured to the horizontal sash posts 51, 52 via screws 72 or similar fastening means to further protect the hinge assemblies 65.

Roller bearing assemblies 73 are provided adjacent the lower corners of the lower sash portion 25. As shown in FIGS. 8 and 9, a generally U-shaped element 74 has its central portion weldably secured adjacent the inside surface of the lower end of the outermost vertical sash post 54 and the end of the lower horizontal sash post 53. The parallel leg portions are provided with apertures and extend perpendicularly away from the plane of the panels 26 toward the wall 17. An intermediate U-shaped guide 75 may be provided between the leg portions of the element 74 with its closed intermediate portion facing the wall 17 and its end portions secured to the intermediate portion of the element 74. An axle 76 is journaled within the apertures of the U-shaped member 74 and a roller member 77 is mounted adjacent to the end of the axle 76 and secured thereto by a hub element 78. The roller member 77 is disposed between the rail track element 42 and 43 within the track space 44 so that it is free to rollably rotate as it is selectively moved up and down within the track space 44 as illustrated in FIGS. 2,3,8 and 9.

Figure 11:
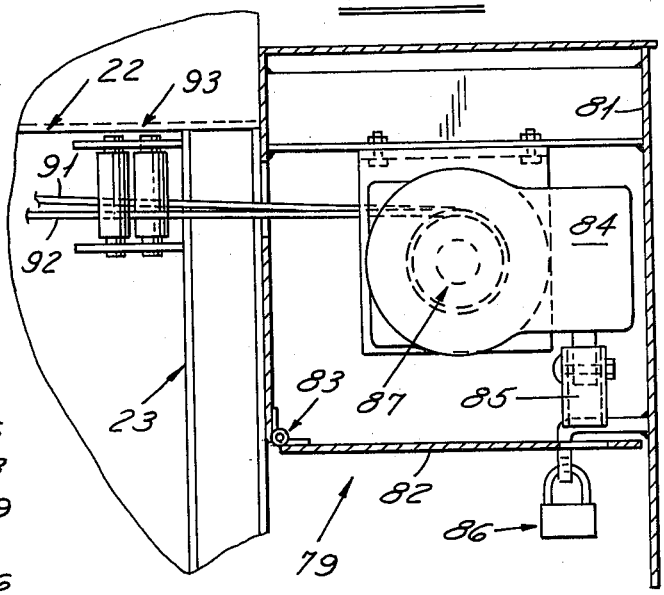
FIG. 11 is a sectional front view taken along view lines II—II of FIG. 4 showing the winch apparatus, cables and guide means of the present invention.
Figure 10:
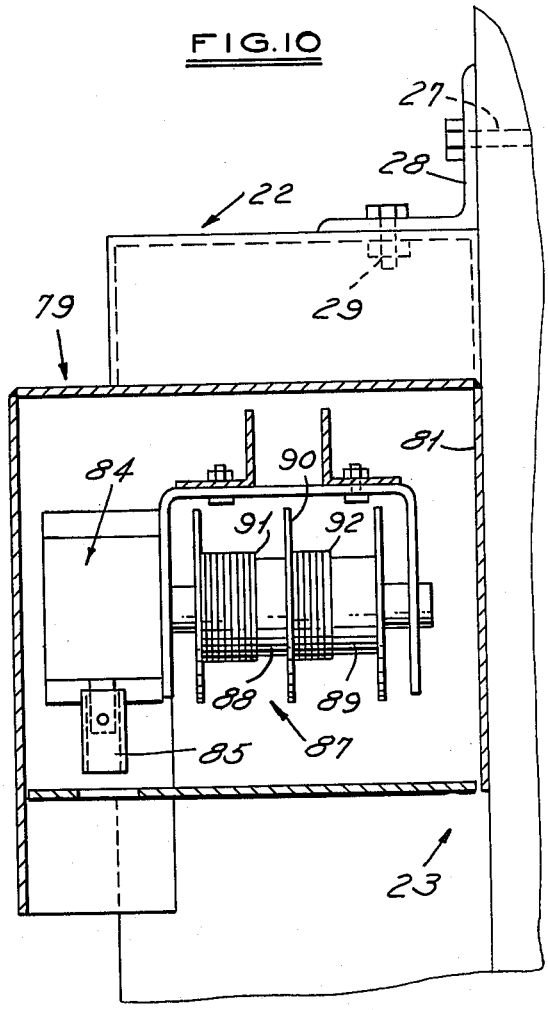
FIG. 10 is a sectional side view taken along the view lines 10—10 of FIG. 1 and illustrating the hinge apparatus of the preferred embodiment of the present invention.
Figure 15:
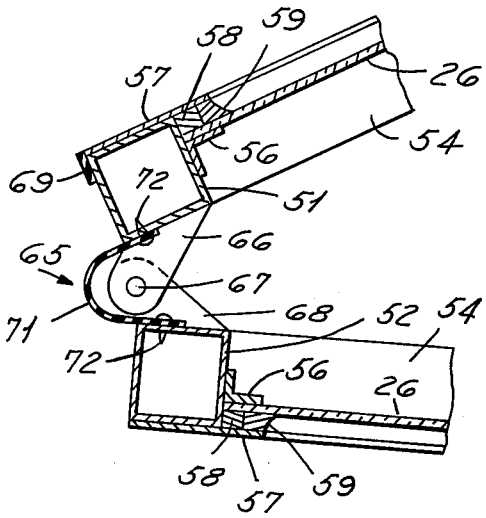
FIG. 15 is a detailed side view of the hinge portion of the assembly of FIG. 3 showing in detail the hinge means of the preferred embodiment of the present invention when the dual purpose security shutter and awning assembly is in the opened awning position.

In the preferred embodiment of the present invention, a winch assembly 79 is rigidly secured to the frame 21 adjacent one end of the top portion 22 thereof. The winch assembly 79 is protectively sealed within a housing 81 as shown in FIGS. 4, 10 and 11. The housing 81 may have a lower access door 82 which is hingeably connected to one side of the housing 81 by a conventional hinge assembly 83. When the door 82 is opened, access may be had to the winch 84 for selectively operating the same by manually rotating the operating shaft 85, as known in the art. When the access door 82 is in the closed position, it may be securely locked in the closed position by means of a conventional hasp lock assembly 86 or the like.

The winch 84 of the present invention employs a winch drum 87 having a first drum portion 88 and a second drum portion 89 which are separated by a separating member 90. A first cable 91 has one end anchored to the first drum portion 88 and wound thereon while a second cable 92 has one end anchored to the drum portion 89 and wound thereon. The cables 91 and 92 then pass through a guide assembly 93 secured adjacent to the top of the side portion 23.

A first pulley 94 is suspended from the bottom of the top support 22 adjacent one end of the assembly 16 and a second pulley 95 is suspended from the bottom of the opposite end of the top member 22. An intermediate portion of the first cable 91 passes through the guide means 93 and then passes over the pulley 94 and then downwardly until its opposite end is secured to the shaft 76 at anchor point 80 adjacent one lower end of the second sash portion 25. The second cable 92 has its intermediate portion passed between the guide assembly 93 and over the second pulley 95 and then downwardly to have its opposite ends anchored or secured to the shaft 76 of the roller bearing assembly 73 at anchor point 80. The pulleys 94 and 95 translate the substantially horizontal motion of the cables 91 and 92 into a substantially vertical or up and down movement of the roller bearing assemblies 73.

In operation, when the operating shaft 85 is selectively rotated, the drum 87 turns to selectively wind or unwind the cables 91, 92 from their respective drum portions 88, 89. The winding and unwinding of the cables 91, 92 is translated into a lifting motion by the pulleys 94, 95 to selectively raise and lower the roller bearing assemblies 73 causing the roller elements 77 to ride up and down in the tracks 41. When the winch is operated to unwind the cables 91, 92 from the drum 87, the roller elements 77 ride down the track 41 until it reaches its lowermost limit. At that position, as illustrated in FIG. 2, the plane of the panels 26 of the upper sash portion 24 are coplanar with the plane 26 of the lower sash portion 25 and generally parallel to the wall 17. In the closed security shutter position, the assembly 16 occupies very little space and does not interfere with or block pedestrian traffic in front of the building. Furthermore, because of the pleasing aesthetic appearance of the panels 26, the assembly 16 does not present an ominous or foreboding atmosphere even when it is locked in the closed security shutter position during non-business hours.

When the operating shaft 85 of the winch 84 is operated to rotate the drum 87 so as to wind up the cables 91, 92, then the roller elements 77 are raised up in the track 41 and when this approaches the upper stop limit 46, as shown in FIG. 3, the assemblies 16 may be locked in the fully opened awning position. Since the nature of the winch 84 may be selected to provide any desired mechanical advantage, the apparatus of the present invention may be easily operated and maintained and quickly raised and lowered as the need arises.

Figure 13:
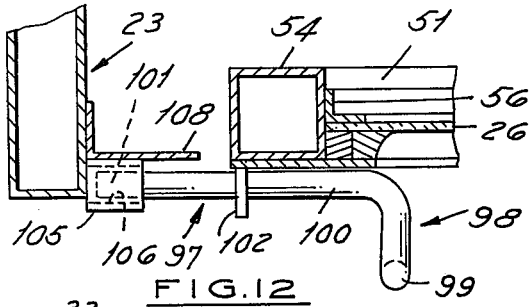
FIG. 13 is a sectional top view taken along view lines 13—13 of FIG. 12 of the locking apparatus of the preferred embodiment of the present invention.
Figure 12:
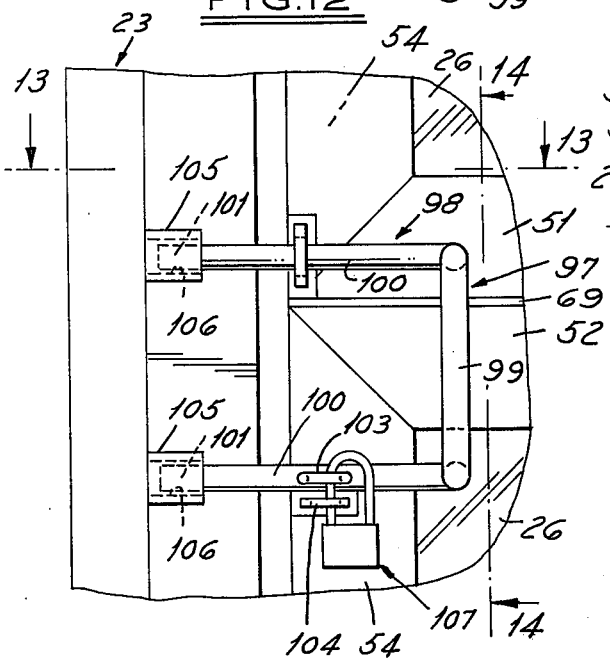
FIG. 12 is a fragmentary front view of the locking means of the preferred embodiment of the present invention.
Figure 14:
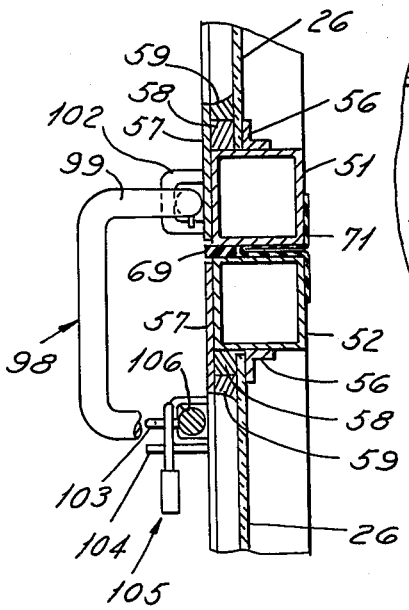
FIG. 14 is a sectional side view taken along view lines 14—14 of FIG. 12 and illustrating the locking apparatus of the preferred embodiment of the present invention.

When the dual purpose security shutter and awning assembly of the present invention is in the fully closed security shutter position, as illustrated in FIG. 2, it may be locked in that position by means of a locking assembly 97 which is shown in some detail in FIGS. 12, 13 and 14. While any suitable type of locking device 97 may be utilized with the assembly of the present invention, the locking apparatus 97 of the preferred embodiment will be briefly discussed hereinbelow. A generally U-shaped sliding element 98 having a raised intermediate handle portion 99 and a pair of legs 100 having end portions 101 is provided. Another U-shaped guide element 102 having its ends weldably secured to the lower corner of the outer most vertical sash post 54 of the upper sash portion 24 is provided for slideably receiving within its central bight one leg portion 100 of the slideable element 98 for supportably carrying same. The opposite leg 100 of the slideable element 98 is provided with still another U-shaped element 103 having its legs welded to the outermost surface of the leg 100 so that the closed portion of the element 103 extends in a direction perpendicular to and outwardly from the wall 17. A correspondingly shaped U-shaped element 104 has its end portions weldably secured to the front of the outer most vertical sash post 54 of the lower sash portion 25 for a purpose to be described hereinafter. A pair of socket elements 105 having central hollow bores 106 therein are weldably secured to the side portions 23 of the frame 21 such that the apertures 106 are disposed adjacent to and facing the ends 101 of the legs 100 of the slideable element 98. When the handle 99 is manually grasped and the element 98 is moved to the left as shown in FIG. 12 such that the upper leg 100 slides within the guide means 102, the ends 101 of the legs 100 will be telescopically received within the apertures 106 of the socket elements 105 until they are fully positioned therein. At that point, the central opened bight portions of the U-shaped elements 103 and 104 will be aligned vertically with one another and an ordinary hasp lock 107 may be passed through the opened portions and locked to prevent relative movement of the slideable element 98 with respect to the socket elements 105, as conventionally known. Various shielding elements 108 may be used to prevent access to various portions of the assemblies 16, as desired.

With this detailed description of the specific apparatus used to illustrate the prime embodiment of the present invention and the operation thereof, it will be obvious to those skilled in the art that various modifications can be made in the structure and materials used in making it and in the operation of the present invention without departing from the spirit and scope thereof which is limited only by the appended claims.

I claim:

1. A dual purpose security shutter and awning adapted to be mounted on the exterior of a building generally over the door and window elements thereof for protecting same, said assembly being positionable to both an opened position to serve as an awning in front of the building and to a closed position to serve as a security shutter which extends across the door and window elements, said assembly comprising:

a frame adapted to be secured to the front of said building about said door and window elements, said frame having a generally horizontal top support member and a pair of generally vertical opposite side members disposed between the opposite ends of said top member and a ground plane;

vertically disposed track means carried by each of the side members of said frame; each of said track means having a length less than the length of the corresponding side member; stop elements carried by said track means adjacent the upper ends thereof;

first and second generally rectangular sash assemblies each having an upper end portion, a lower end portion and a pair of side portions;

first hinge means connecting the top support member of said frame to the upper end portion of said first sash assembly for pivotally suspending said first sash assembly within said frame such that the plane of said first sash assembly is substantially vertical and generally parallel to the front of said building when said dual purpose security shutter and awning assembly is closed and such that the lower end portion of said first sash assembly swings away from said vertical plane and the plane of said first sash assembly which faces the front of said building forms an acute angle with that portion of said vertical plane vertically below said first hinge means when said dual purpose security shutter and awning assembly is opened;

second hinge means connecting the lower end portion of said first sash assembly to the upper end portion of said second sash assembly for at least partially pivotally suspending said second sash assembly within said frame such that the planes of said first and second sash assemblies are vertically coplanar when said dual purpose security shutter and awning assembly is closed and such that the angle between the plane of said second sash assembly facing the front of said building and the plane of said first sash assembly facing the front of said building decreases as the lower end portion of said first sash assembly and the upper end portion of said second sash assembly swing outwardly away from said vertical plane until an acute angle is formed therebetween when said dual purpose security shutter and awning assembly is opened;

at least one substantially planar, generally rectangular, relatively burglar-resistant panel retainably carried by each of said sash assemblies;

roller bearing means carried by the opposite side portions of said second sash assembly adjacent the lower end portion thereof for operatively engaging the corresponding track means carried by the opposite side members of said frame and riding up and down therein as said dual purpose security shutter and awning assembly is moved between said closed and opened positions; the upward movement of said roller bearing means being limited by the engagement of same with said stop elements;

winch means carried by said frame for selectively opening and closing said dual purpose security shutter and awning assembly, said winch means including cable means having one end coupled to said second sash assembly adjacent said lower end portion thereof, a rotatable drum having the opposite end of said cable means anchored thereto for winding and unwinding said cable means thereon for raising and lowering said roller bearing means within said track means, and means for driveably rotating said drum to selectively control the positioning of said sash assemblies;

said winch means being further characterized in that said rotatable drum has first and second drum portions thereon, said cable means includes first and second distinct cable elements, said one end of said first cable element being coupled to said second sash assembly adjacent one side thereof and the opposite end of said first cable element being anchored to said first drum portion, said one end of said second cable element being coupled adjacent the opposite side portion of said second sash assembly and the opposite end of said second cable element being anchored to said second drum portion such that as said drum is driveably rotated to selectively control the position of said dual purpose security shutter and awning assembly, said second sash assembly being raised and lowered from opposite ends thereof causing said roller bearing means to ride up and down within said track means thereby moving said sash assemblies between said opened awning position and said closed shutter position;

first and second pulleys carried by said top member of said frame adjacent opposite ends thereof such that an intermediate portion of said second cable element passes over said first pulley and an intermediate portion of said second cable element passes over said second pulley to transmit the rotation of said drum into the vertical translation of said roller bearing means within said track means; and means for selectively locking said sash assemblies in said closed shutter position.

2. The dual purpose security shutter and awning assembly of claim 1 wherein each of said first and second generally rectangular sash assemblies are modular and each includes at least two individual rectangular sash sections having adjacent side portions securely coupled together so that each of said first and second sash assemblies moves as a generally rigid integral unit, the number of individual sash sections included in each of said first and second generally rectangular sash assemblies being modularly adjustable to selectively increase or decrease the size of said sash assemblies depending upon the size of the area of the building wall to be protected.

3. The dual purpose security shutter and awning assembly of claim 1 wherein the end portion of at least one said first and second generally rectangular sash assemblies which faces the adjacent end portion of the other said first and second generally rectangular assemblies includes a shielding spacer means for preventing tampering with said first and second hinge means and for preventing said sash assemblies from attaining an over the center position when fully closed.

4. The dual purpose security shutter and awning assembly of claim 1 wherein said at least one panel retainably carried by each of said sash assemblies includes a pane of generally rigid plastic material.

5. The dual purpose security shutter and awning assembly of claim 1 wherein said at least one panel retainably carried by each of said sash assemblies bears a decorative design or pattern thereon.

6. The dual purpose security shutter and awning assembly of claim 1 wherein said at least one panel retainably carried by each of said sash assemblies includes a pane of plexiglass material.

7. The dual purpose security shutter and awning assembly of claim 1 wherein said at least one panel retainably carried by each of said sash assemblies includes an aesthetically appealing metal grating.

8. The dual purpose security shutter and awning assembly of claim 1 wherein said locking means includes a manually positionable element slideably carried by one of either a side of said frame and said second sash assembly, said slideable element having at least one end portion, socket means rigidly secured to the other of said one side of said frame and said second sash assembly for telescopically receiving said one end portion of said slideable element therein, and means for securely locking said slideable element within said socket element to prevent said sash assemblies from being moved out of said closed security shutter position for security purposes.

9. A combination security shutter and awning comprising:

a frame adapted to be secured to the wall of a building and the like, said frame having a top portion and opposite side portions disposed about at least one wall opening;

first and second sash means each of which is adapted to mount at least one protective panel therein, said sash means being positionable to a closed shutter position wherein the plane of said first sash means is substantially parallel to the plane of said second sash means and generally coplanar therewith for protectively sealing said at least one wall opening and to an opened awning position wherein the plane of said first sash means facing said wall forms an acute angle with the plane of said second sash means facing said wall for permitting unobstructed access to said at least one wall opening;

means for selectively raising and lowering said sash means between said closed shutter position and said opened awning position;

means for locking said sash means in said closed shutter position for security purposes; said first and second sash means each including a plurality of generally rectangular sashes adapted to be arranged in a modular array between said frame portions, the number of sashes in said array and the size thereof being determined by the size of the wall area to be protected, said first sash means including at least two of said rectangular sashes having their adjacent edge portions generally rigidly secured together to enable said first sash means to move at an integral unit, said second sash means including at least two of said rectangular sashes having their adjacent edge portions generally rigidly secured together to enable said second sash means to move as an integral unit, and hinge means pivotally connecting the lower edge portion of said first sash means to the upper edge portion of said second sash means for allowing said first and second sash means to pivotally rotate with respect to one another in a flap-like manner as said sash means are selectively moved between said opened awning position in said closed shutter position;

said means for selectively raising and lowering said sash means including track means carried by said opposite side portions of said frame, roller bearing means carried by opposite side portions of said second sash means adjacent the lower edge portion thereof for operatively engaging corresponding ones of said track means, and positioning means for selectively raising and lowering said roller bearing means within said track means to selectively position said sash means;

said positioning means for selectively raising and lowering said roller bearing means including cable means having one end secured adjacent said lower edge portion of said second sash means and a winch means including a drum operatively coupled to the opposite end of said cable for selectively winding and unwinding said cable from said drum to selectively raise and lower said roller bearing means within said track means;

said positioning means for selectively raising and lowering said roller bearing means being further characterized in that said cable means includes first and second cables wound on first and second portions of said drum and further including first and second pulleys suspended from the top portion of said frame adjacent to the opposite ends thereof, said first cable passing over said first pulley and having said one end secured adjacent one edge portion of said second sash means, said second cable passing over said second pulley and having said one end secured adjacent the opposite edge portion of said second sash means such that as said drum is rotated to selectively wind and unwind said first and second cables thereon, said roller bearing means will be selectively raised and lowered within said track means for positioning said sash means.

10. The combination security shutter and swing assembly of claim 9 wherein at least one of said first and second sash means includes spacer means extending at least partially over the edge thereof which faces the adjacent edge of the other of said first and second sash means for shielding said hinge means to prevent tampering and the attainment of an over the center condition of said sash means.

11. The combination security shutter and awning assembly of claim 9 wherein at least one protective panel includes a generally burglar-resistant sheet of plastic material having a decorative design thereon.

12. The combination security shutter and awning assembly of claim 9 wherein said at least one protective panel includes a sheet of plexiglass material.

13. The combination security shutter and awning assembly of claim 9 wherein said at least one protective panel includes a sheet of metallic mesh having a pleasing appearance.

14. The combination security shutter and awning of claim 9 wherein said locking means includes a generally U-shaped manually slideable element carried by at least one of said first and second sash means, a pair of socket members ridgely secured to one of said side portions of said frame, each of said socket members having a central bore adapted for telescopically receiving one of the ends of said U-shaped member, a first C-shaped element ridgely secured to and carried by said U-shaped member, a second correspondingly configured C-shaped element rigidly secured to one of said first and second sash means such that when said U-shaped member is slideably positioned so that its ends are telescopically received within the central bores of said socket means, said C-shaped elements are aligned with one another, and a lock adapted to pass within the bite of said C-shaped elements for selectively locking them with respect to one another to prevent moving said assembly from said closed security shutter position.

* * * * *